US005782147A

United States Patent [19]

Chaconas et al.

[11] Patent Number: 5,782,147

[45] Date of Patent: Jul. 21, 1998

[54] RATCHET WRENCH HAVING TWO-PAWL ACTION

[75] Inventors: Peter Constantine Chaconas, Glyndon, Md.; James A. Van Lenten, Lancaster, Pa.

[73] Assignee: Hand Tool Design Corporation, Wilmington, Del.

[21] Appl. No.: 754,646

[22] Filed: Nov. 21, 1996

[51] Int. Cl.[6] ..... B25B 13/46

[52] U.S. Cl. ..... 81/63.1; 192/43.1

[58] Field of Search ..... 81/63.1, 63.2; 192/43.1

[56] References Cited

U.S. PATENT DOCUMENTS 593,157 11/1897 Furbish .

1,513,212 10/1924 Beale et al. .

2,134,420 10/1938 Smith, Sr. ..... 188/81

2,978,081 4/1961 Lundin ..... 192/43.1

*Primary Examiner*—James G. Smith

*Attorney, Agent, or Firm*—Leonard Bloom

[57] ABSTRACT

A ratchet wrench having at least one gear disposed in an opening in the head of the wrench. An upper pawl and a lower pawl are disposed in a stacked arrangement in a second opening in the head of the wrench. The openings are in communication with one another. A lever is connected to the pawls to simultaneously move both pawls between a forward and a reverse position. The teeth on the pawls work conjointly and alternately engage the teeth on the at least one gear as the wrench is ratcheted thereby producing a reduction in the backswing arc of the wrench.

14 Claims, 6 Drawing Sheets

RATCHET WRENCH HAVING TWO-PAWL ACTION

BACKGROUND OF THE INVENTION

The present invention relates to a ratchet wrench which incorporates two pawls and more particularly, to a ratchet wrench in which the teeth on one of the pawls are out of phase with teeth on the gear in the wrench.

Ratchet wrenches frequently must be used in situations where there is insufficient clearance to fully rotate the wrench and obtain an effective ratcheting action for either tightening or loosening a fastener. In order to overcome this problem, wrenches with a greater number of teeth on the gear have been utilized. This reduces the back swing arc and permits use of the wrench in confined spaces. However, the greater number of teeth result in a plurality of thinner (or fine) teeth, each of which has lesser mechanical strength than the teeth on a standard ratchet. There is a higher frequency of damage to the fine teeth.

The present invention overcomes this problem by using the standard coarser gear with two pawls and having the teeth on one pawl out of phase with the teeth on the gear.

The applicant is aware of the following devices which disclose a wrench and two pawls.

U.S. Pat. No. 593,157 issued to Furbish discloses a compact ratchet for a drill or screwdriver having a double pawl and ratchet mechanism wherein there is a forward feed ratchet, or a reverse feed ratchet, or a lock to the handle to the blade in the case of a screwdriver. Various embodiments are disclosed.

U.S. Pat. No. 1,513,212 issued to Beale et al discloses a speed ratchet wrench which can rotate in one direction or the other. Two pawls can be locked into engagement with ratchet members by setting a finger piece.

U.S. Pat. No. 2,134,420 issued to Smith, Sr. discloses a controlling device for a rotatable member, such as a rock drill, to prevent unauthorized rotation of the rotatable member and to selectively control the direction of rotation of the rotatable member. A pair of ratchet rings having teeth, a pair of pawls, cams, and a feed screw are provided in the device.

U.S. Pat. No. 2,978,081 issued to Lundin discloses various devices in ratchet wrenches so that efficient rotating of a screw bolt, and the like, by very short strokes may be obtained in very confined spaces. A very strong force transmitting effect is obtained when all of the teeth on two pawls engage the ratchet wheel. The pawls are disposed in a side-by-side arrangement and the pawls and gears are in phase with each other.

Although these wrenches have been known for many years, there still is no commercially available wrench which fulfills this longstanding need.

BRIEF SUMMARY OF THE INVENTION

It is an object of the present invention to provide a ratchet wrench which can be used in confined spaces.

It is a further object of the present invention to provide a ratchet wrench which has sturdy teeth which are resistant to damage and which permits a 50% reduction in the backswing arc.

In accordance with the teachings of the present invention, there is disclosed a ratchet wrench having a head. The head has a bottom, a first opening formed in the head and a second opening formed in the head communicating with the first opening. At least one gear is disposed in the first opening, the at least one gear having a plurality of teeth formed axially thereon. A plurality of pawls are disposed in a stacked arrangement in the second opening. Each pawl has a set of teeth oriented toward, and engageable with, the teeth on the at least one gear. A lever is engaged with the plurality of pawls wherein rotation of the lever simultaneously moves the plurality of pawls between a forward and a reverse position. In this manner, the teeth on the pawls work conjointly and alternately engage the teeth on the at least one gear as the wrench is ratcheted, thereby producing a reduction in the backswing arc of the ratchet wrench.

In another aspect, two pawls engage a single gear. The gear has teeth on an upper element and teeth on a lower element. The teeth on the elements are approximately one-half phase displaced from one another.

In still another aspect, the teeth on an upper pawl are approximately one-half pitch displaced from the teeth on a lower pawl.

In a further aspect, the pawls are identical and asymmetrical, the pawls being inverted with respect to one another such that the teeth on the upper pawl are approximately one-half pitch displaced from the teeth on the lower pawl.

In yet another aspect, an upper gear and a lower gear are vertically stacked in the first opening in the head. The teeth on the respective gears are approximately one-half pitch out of phase with one another. The teeth on each gear are engaged by the teeth of the respective upper and lower pawl, the teeth on the respective pawls being in phase with one another.

Viewed from another aspect there is disclosed a ratchet wrench having a pawl means cooperating with a gear means. The improvement is either one of the pawl and gear means has two elements stacked vertically and mounted for conjoint rotation. The two elements are staggered circumferentially with respect to each other.

These and other objects of the present invention will become apparent from a reading of the following specification taken in conjunction with the enclosed drawings.

DESCRIPTION

Figure 1:
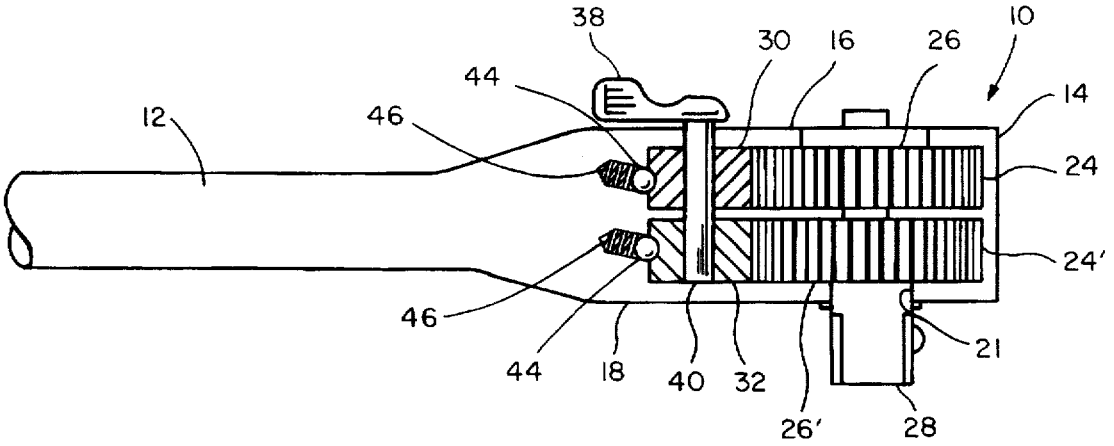
FIG. 1 shows a partial cross section view of the ratchet wrench of the present invention having two pawls and two gears.
Figure 2:
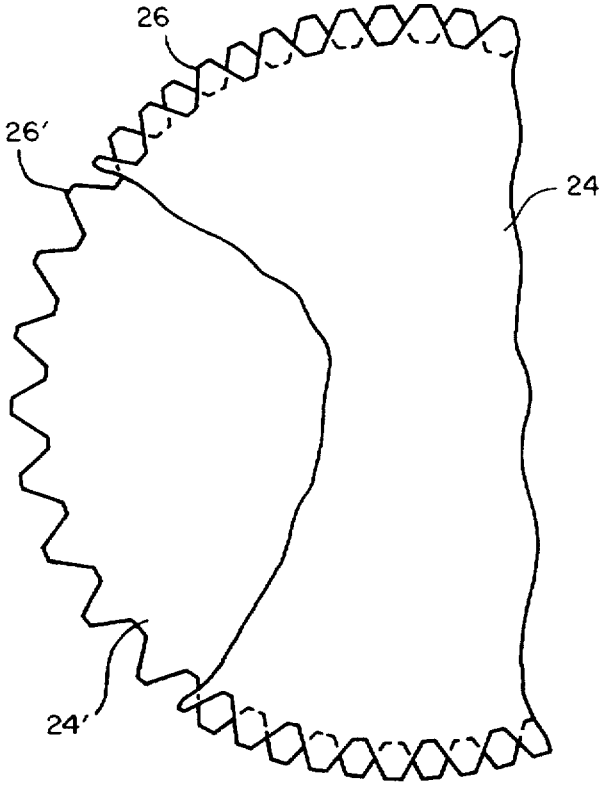
FIG. 2 is an enlarged partial cut-away top plan view showing the teeth on the upper gear out of phase with the teeth on the lower gear.
Figure 3:
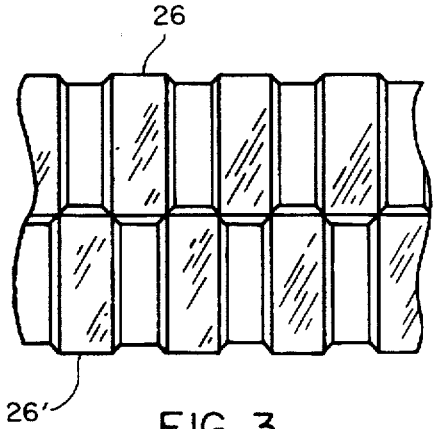
FIG. 3 is an enlarged partial front plan view of the gear.
Figure 4:
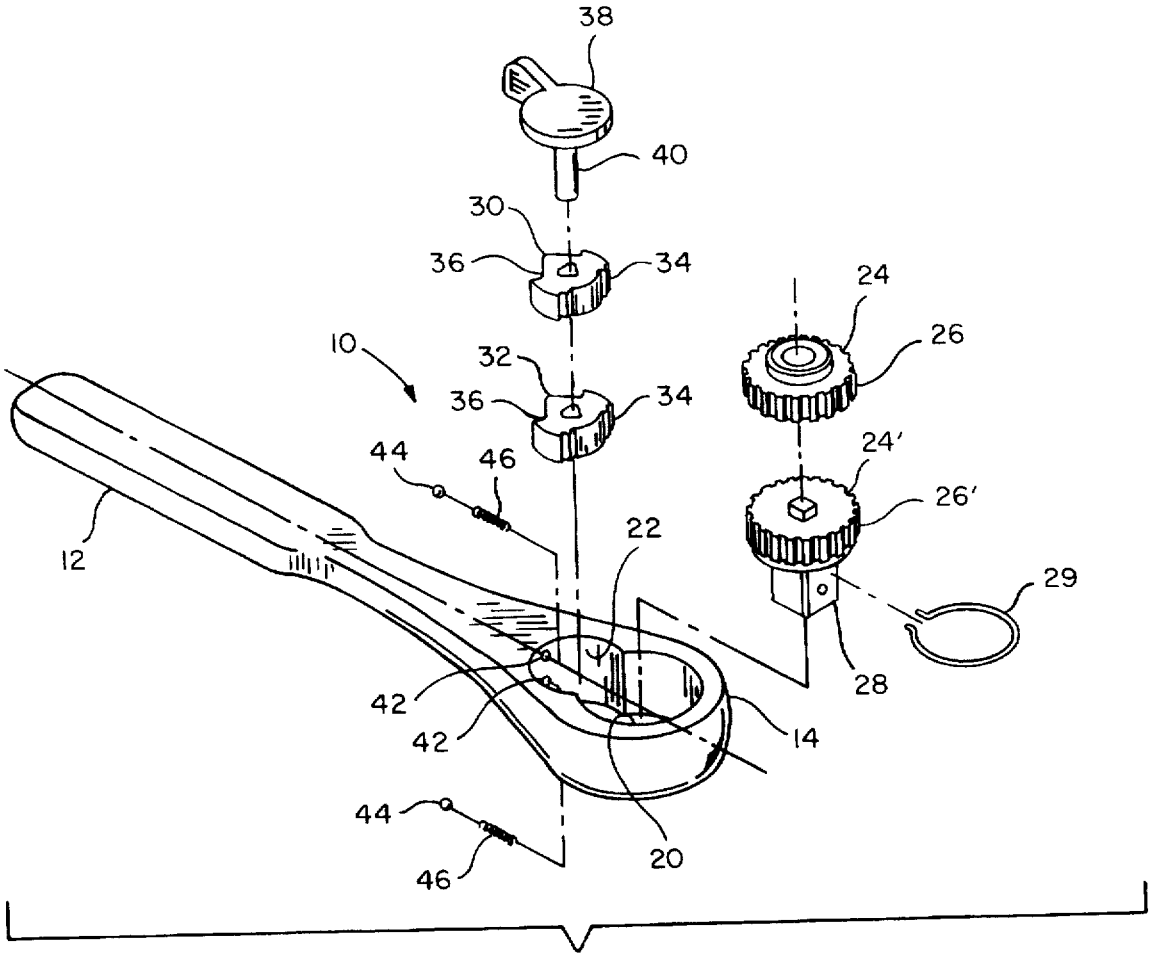
FIG. 4 is an exploded view of the ratchet wrench of the present invention having two separate gears.

Referring now to FIGS. 1–6, the ratchet wrench 10 of the present invention has a handle 12 integral with the head 14. The head 14 has a top surface 16 and a bottom surface 18. A first opening 20 is formed in the head 14, having an access opening 21 to the bottom surface 18. A second opening 22 is formed in the head 14 between the first opening 22 and the handle 12. The second opening 22, preferably is formed from the top surface 16 of the head 14 and is not a through hole but rather, terminates near the bottom surface 18 of the head 14. The first opening 20 and the second opening 22 communicate with one another.

At least one gear 24 is disposed in the first opening 20. A plurality of teeth 26 are formed axially on the at least one gear 24.

A drive tang 28 is formed on the at least one gear 24, the drive tang 28 extending outwardly from the bottom surface 18 of the head through the access opening 21. Preferably, an expandable split ring 29 is received in the tang 28 and retains the gear in the opening 20. Alternately, the at least one gear 24 may have an axial opening therein to receive a fastener or other workpiece.

An upper pawl 30 and a lower pawl 32 are disposed in a stacked arrangement in the second opening 22 such that teeth 34 on the respective pawls 30,32 are oriented toward the at least one gear 24 and the teeth 34 on the respective pawls 30, 32 engage and cooperate with the teeth 26 on the at least one gear 24 as will be described. Each pawl 30, 32 has a pair of adjoining pockets 36 on the respective pawls on the side opposite to the teeth 34.

A lever 38 is disposed on the top surface 16 of the head and is connected to the pawls 30, 32 preferably by a stem 40 which extends downwardly into an opening in each of the pawls 30,32. Rotation of the lever 38 simultaneously moves both of the pawls between a forward and a reverse position.

A pair of blind bores 42 are formed in the second opening 22, the bores 42 being oriented toward the handle 12. The bores 42 may be directly aligned vertically or may be slightly off-set from one another. In each bore 42, there is disposed a detent mechanism such as a ball 44 and spring 46 or other detent means known to persons skilled in the art. The detent mechanisms cooperate with the respective pockets 36 in the respective pawls 30, 32 such that the detent mechanism is urged against one or the other of the adjacent pockets 36 as the lever is moved between the forward and the reverse position. The detent mechanism urges the respective pawls toward the at least one gear 24 so that the selected teeth 34 on the respective pawl 30, 32 engage the teeth 26 on the at least one gear 24.

In one embodiment, as shown in FIGS. 1–4, two gears 24, 24' are provided. The gears are disposed in a vertical stacked arrangement such that an upper gear 24 is aligned in a plane with the upper pawl 30 and a lower gear 24' is aligned in a plane with the lower pawl 32. The teeth 34 on the respective symmetrical identical pawls 30, 32 cooperate with the teeth 26, 26' on the respective gears 24, 24'. The teeth 26 on the upper gear 24 are approximately one-half pitch circumferentially out of phase with the teeth 26' on the lower gear 24'. The two gears 24, 24' are interconnected so that the gears 24, 24' are moved conjointly. In this embodiment the pawls 30, 32 are directly aligned so that the teeth 34 on the respective pawls 30, 32 are in phase with one another.

In use, a socket or other tool accessory (not shown) is attached to the tang 28. The wrench 10 is placed in the confined space and the tool accessory is connected to the workpiece. The lever 38 is placed in the desired forward or reverse position and the handle pushed or pulled as desired to loosen or tighten. As torque is applied to the handle, teeth 34 on either the upper pawl 30 or the lower pawl 32 are engaged with the corresponding teeth 26, 26' on the aligned gear 24, 24' and thereby transmit the applied torque to the engaged gear. The teeth 34 on the other pawl 30,32 are not engaged with the teeth 26, 26' on the non-aligned gear 24, 24' which are out of phase. Continued application of torque to the handle moves the handle to a position where further movement of the handle is restricted due to the confined space. A back swing is required to move the handle to again permit transmittal of torque. In the back swing, the teeth 34 of the pawl disengage from the teeth 26 on the gear. In the device as disclosed herein, when the back swing has been completed, the out of phase gear 24, 24' becomes in phase with the aligned pawl and the teeth on the respective pawl 30, 32 and gear 24, 24' are now fully engaged with a reduced arc of back swing as compared to a wrench of the prior art. The device disclosed herein engages the out-of-phase pawl and gear sequentially. As compared to the conventional ratchet wrench, the handle of the wrench disclosed herein only need be moved one-half of the distance in order to have an engagement between pawl teeth and gear teeth. The net effect is equivalent to having doubled the number of teeth on the gear, as for example, from thirty-six teeth set at 10° intervals to seventytwo teeth set at 5° intervals. This is accomplished without reducing the thickness and frangibility of the teeth.

In this manner, the reduction in backward movement of the ratchet wrench is expressed as at least a 50% reduction in the backswing arc. This expression is used because the backswing is a non-driving movement to permit re-engagement of the pawl teeth with the gear teeth. The present device reduces this non-productive movement.

It is possible to have the gear teeth out of phase with one another by greater or less than one-half pitch. However, the effectiveness of the transition from engagement of one pawl vs. the other pawl is reduced when the out-of-phase relationship is greater or less than one-half. The reduction with backswing arc is less than 50% in these situations. It is also possible to have more than two pawls and/or more than two out of phase gears so that reductions in back swing greater than 50% can be produced.

Figure 5:
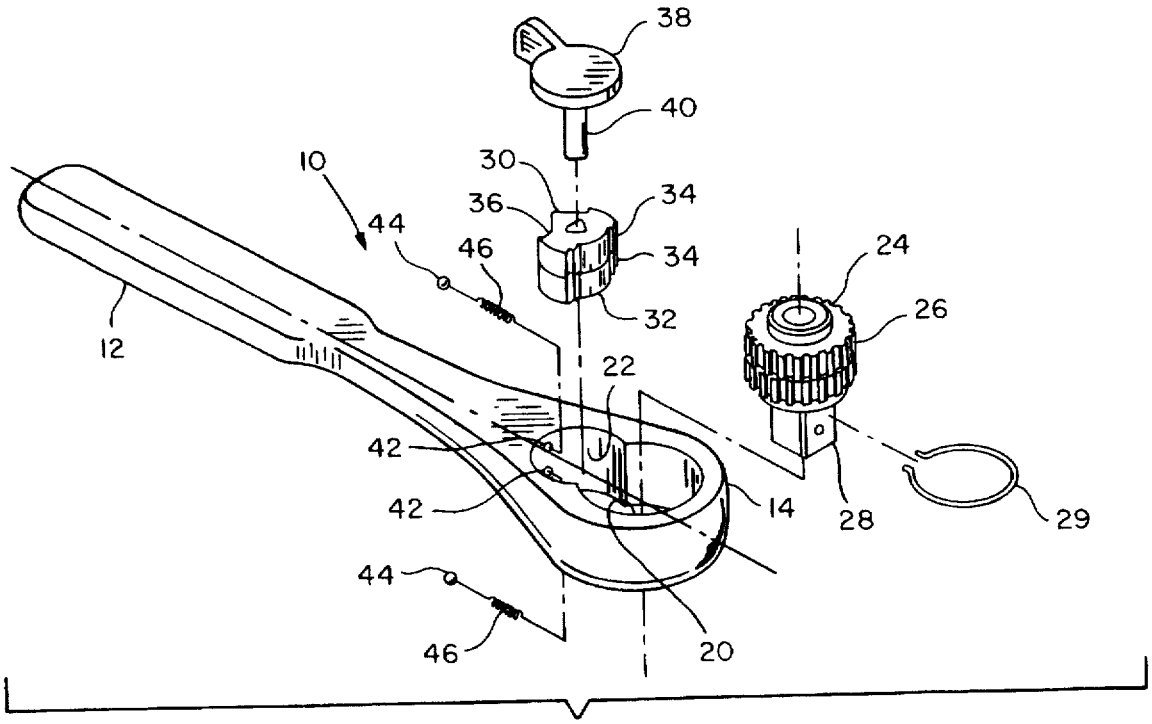
FIG. 5 is an exploded view of the ratchet wrench of the present invention having a single gear with two sets of teeth.

In a second embodiment as shown in FIG. 5, only one gear 24 is disposed in the first opening 20 in the wrench 10.

However, the teeth 26 on the gear 24 are axially disposed in two portions or elements. The teeth in the upper portion are approximately one-half pitch circumferentially out of phase from the teeth on the lower portion. Each single tooth extends only approximately one-half the height of the gear 24. This embodiment has two pawls 30, 32 which are aligned with one another in the same manner as the first embodiment as described above. Except for the presence of a single gear as compared to two gears, the second and first embodiments are otherwise identical.

Figure 6:
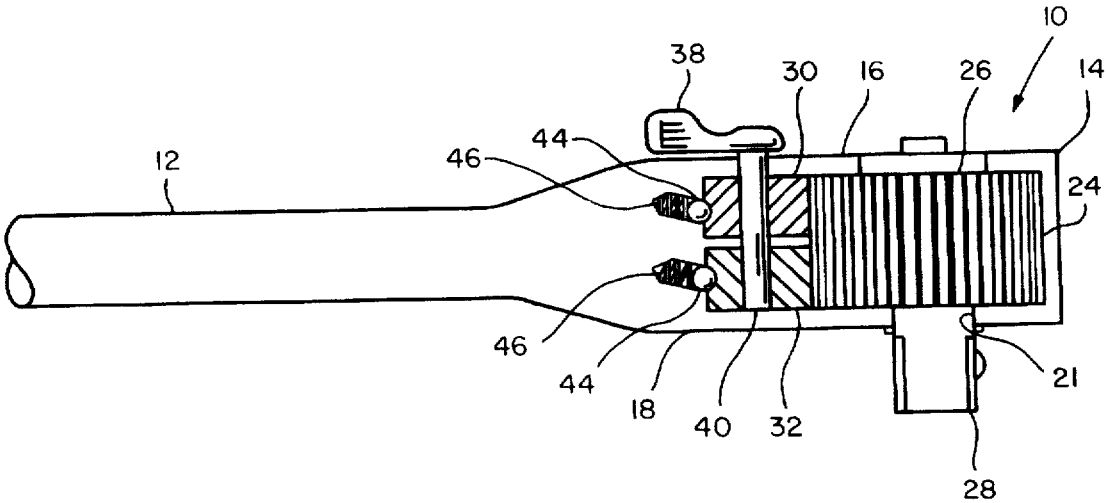
FIG. 6 is a partial cross section of the ratchet wrench of the present invention having two pawls and a single gear with one set of teeth.
Figure 7:
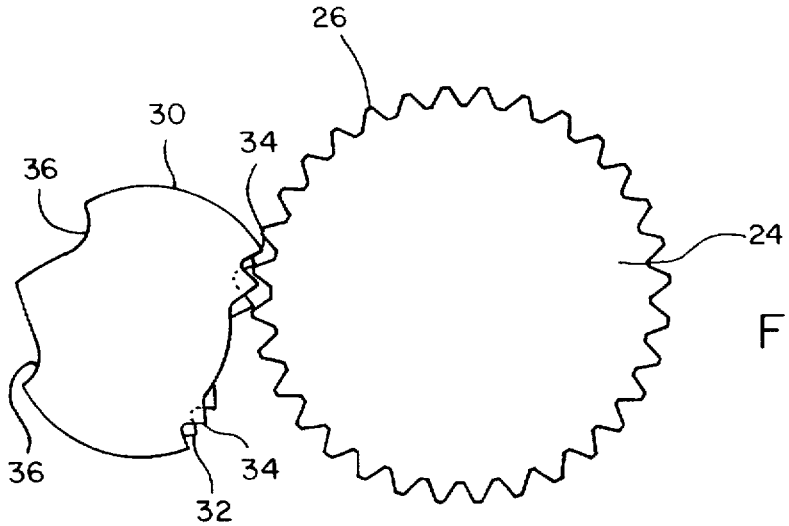
FIG. 7 is a top plan view of two non-identical stacked pawls, the pawls being staggered with respect to one another.

A third embodiment is shown in FIG. 6. In this embodiment, a single gear 24 having a single set of axially aligned teeth 26 is disposed in the first opening 20 in the wrench. All of the teeth extend approximately the entire height of the gear 24. A pair of symmetrical non-identical pawls 30, 32 are disposed in the second opening 22 in the head 14. However, as shown in FIG. 7, the pawls 30, 32 are disposed in the stacked arrangement such that the teeth 34 on the upper pawl 30 and the teeth on the lower pawl 32 are approximately one-half pitch out of phase with one another. Thus, in use, as described above, the effect is the same as if the teeth on the pawls were aligned and the teeth on the gear(s) were onehalf pitch out of phase. As the handle 12 is ratcheted, the set of teeth on one of the pawls engages the teeth on the gear while the set of teeth on the other of the pawls is not engaged as the gear is turned. After the back swing, the set of teeth on the other of the pawls (previously not engaged) now engage the teeth on the gear and the set of teeth on the one of the pawls (previously engaged) become disengaged.

Figure 10:
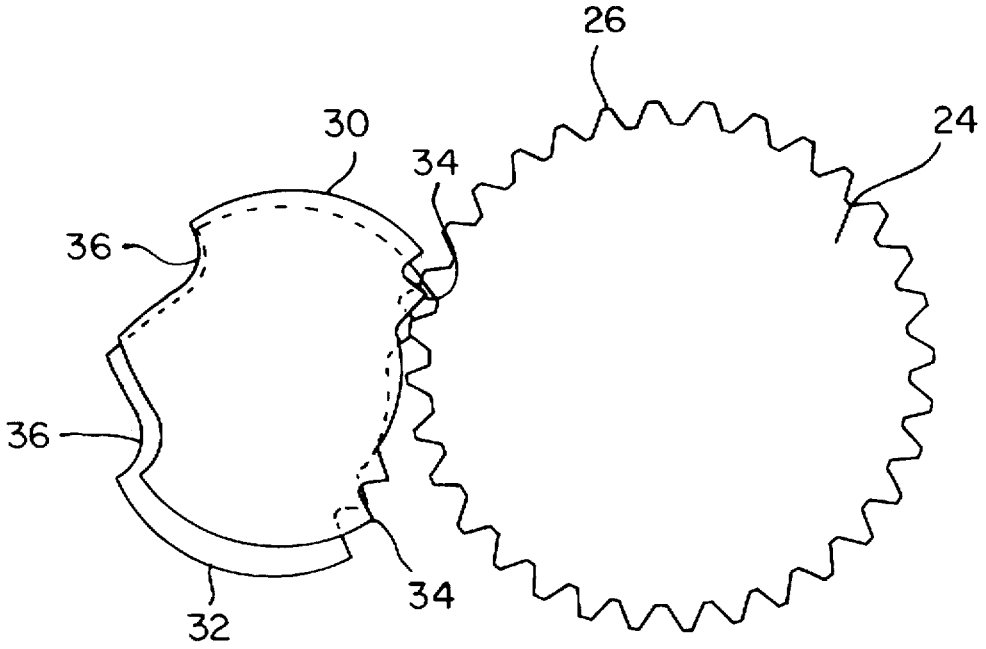
FIG. 10 is a top plan view showing two identical pawls disposed in two offset bores, the pawls being one-half pitch out of phase with one another.
Figure 11:
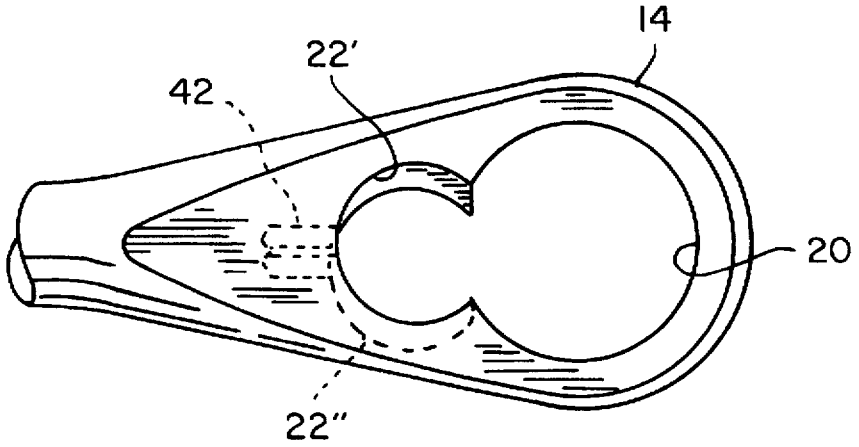
FIG. 11 is a top plan view of the head of the ratchet wrench showing the second opening formed of two offset bores to receive the pawls of FIG. 10.

In a fourth embodiment, as shown in FIGS. 10 and 11, a single gear 24 with a single set of teeth 26 is disposed in the first opening 20 in the head 14. The second opening 22 in the head 14 is formed with an upper portion 22' and a lower portion 22". The portions 22', 22" are offset from each other such that the portions are not concentric. A lower pawl 32 is disposed in the lower portion 22" and an upper pawl 30 is disposed in the upper portion 22'. The pawls 30, 32 are identical and are displaced approximately one-half pitch out of phase with one another due to the offset of the portions of the second opening 22. In this manner, the wrench operates in a manner similar to the other three embodiments and the backswing arc is reduced by 50%.

Figure 9:
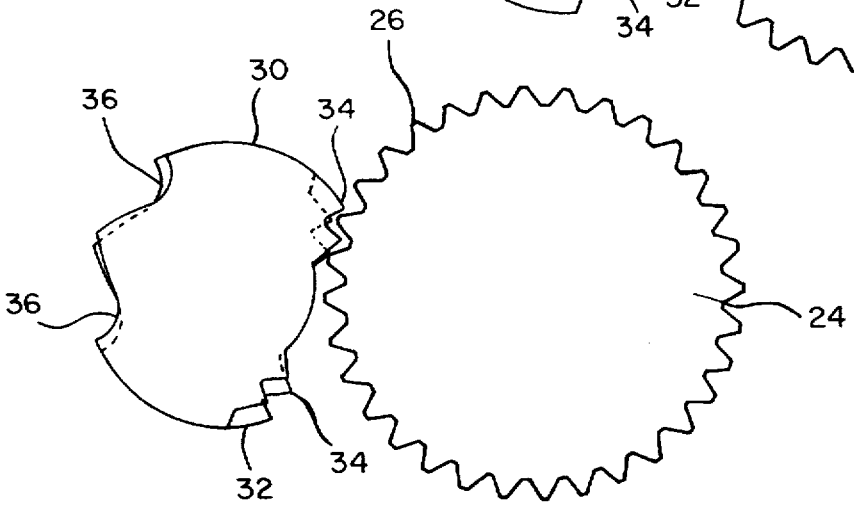
FIG. 9 is a top plan view showing two identical asymmetric stacked pawls, the pawls being one-half pitch out of phase with one another.

In a fifth embodiment as shown in FIG. 9, a single gear 24 with a single set of teeth 26 is disposed in the first opening 20 in the head 14. The two pawls disposed in the second opening 22 are each identical but are asymmetrical. One pawl is disposed in the second opening in an inverted position with respect to the other pawl. In this manner, the teeth on the pawls are approximately one-half pitch out of phase with one another. Thus, in a manner similar to the above-described four embodiments, the teeth on the respective pawls alternately engage the teeth on the gear and work conjointly to drive the gear and tang, and indirectly to drive a tool accessory connected to the tang.

Figure 8:
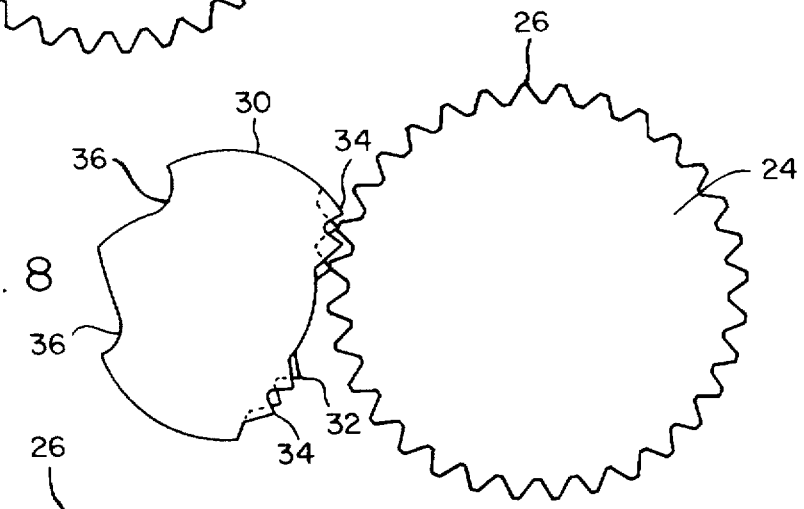
FIG. 8 is a top plan view showing two non-identical asymmetric stacked pawls, the pawls being one-half pitch out of phase with one another.

In a sixth embodiment, as shown in FIG. 8, a single gear 24 with a single set of teeth is disposed in the first opening 20 in the head 14. The asymmetric, non-identical pawls 30, 32 are disposed in the second opening 22. The teeth on the respective pawls are approximately one-half pitch out of phase with one another. The wrench of this embodiment is similar to the abovedescribed embodiments in that the teeth on the respective pawls alternately engage the teeth on the gear and the back swing arc is reduced by approximately 50%.

Figure 12:
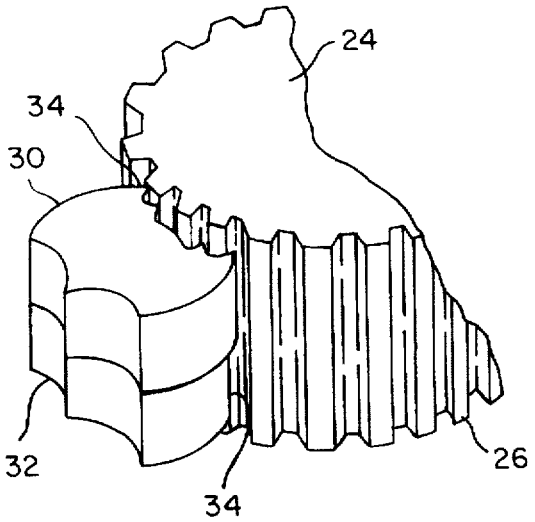
FIG. 12 is an enlarged perspective view showing the teeth on the upper pawl engaged with the upper portion of the teeth on the gear and the teeth on the lower pawl disengaged from the lower portion of the teeth on the gear in the forward swing.
Figure 13:
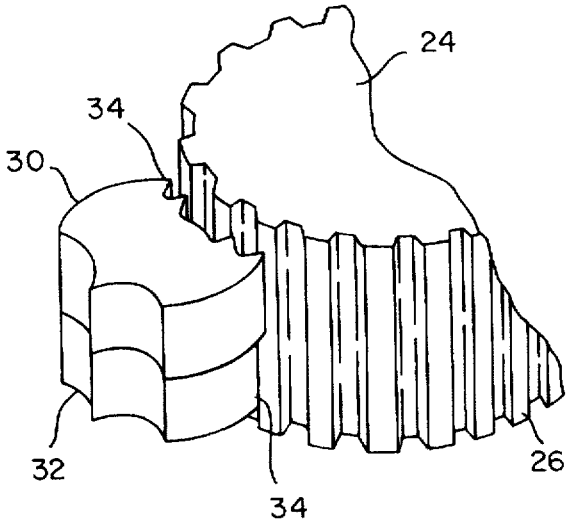
FIG. 13 is an enlarged perspective view showing teeth on both pawls disengaged from the teeth on the gear in the back swing.
Figure 14:
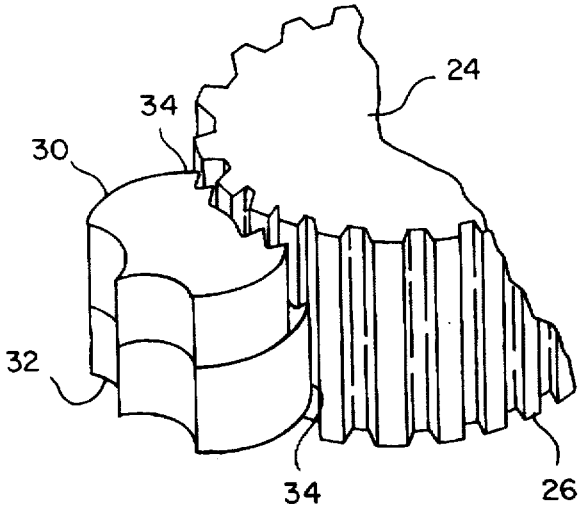
FIG. 14 is an enlarged perspective view in sequence from FIG. 13 showing the teeth on the upper pawl disengaged from the upper portion of the teeth on the gear and the teeth on the lower pawl engaged with the lower portion of the teeth on the gear in a sequential forward swing.

FIGS. 12 and 14 show an example of a sequence in which one pawl is engaged with one gear (or one portion of the gear) and the other pawl is disengaged during the forward swing. FIG. 13 shows disengagement of both pawls during the back swing. The views are enlarged to more clearly show the engagement and disengagement of the pawls from the gear. As the gear rotates the engaged pawl becomes disengaged and the disengaged pawl becomes engaged during the forward swing. As described above, this arrangement of the pawls and gears effectively reduces the movement of the wrench required to produce movement of the gears.

The net result with any of the six embodiments is to provide a ratchet wrench which can be used in confined spaces and produces a fifty percent reduction in backswing arc while retaining a thicker and sturdier set of teeth in the wrench.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. A ratchet wrench having a head, the head having a bottom, a first opening formed in the head, a second opening formed in the head communicating with the first opening, at least one gear disposed in the first opening, the at least one gear having a plurality of teeth formed axially thereon, a plurality of pawls disposed in a stacked arrangement in the second opening, each pawl having a set of teeth oriented toward, and engageable with, the teeth on the at least one gear, a lever engaged with the plurality of pawls wherein rotation of the lever simultaneously moves the plurality of pawls between a forward and a reverse position, wherein the teeth on the pawls work conjointly and alternately engage the teeth on the at least one gear as the wrench is ratcheted, thereby producing a reduction in the backswing arc of the ratchet wrench.

2. The ratchet wrench of claim 1, wherein the teeth on an upper pawl are approximately one-half pitch displaced from the teeth on a lower pawl.

3. The ratchet wrench of claim 1, wherein two pawls engage a single gear, the gear having teeth on an upper element and teeth on a lower element, the teeth on the elements of the gear being approximately one-half phase displaced from one another.

4. The ratchet wrench of claim 1, wherein the pawls are identical and asymmetrical, the pawls being inverted with respect to one another such that the teeth on an upper pawl are approximately one-half pitch displaced from the teeth on a lower pawl.

5. The ratchet wrench of claim 1, wherein the pawls are not identical and are asymmetrical such that the teeth on an upper pawl are approximately one-half pitch displaced from the teeth on a lower pawl.

6. The ratchet wrench of claim 1, wherein the second opening comprises an upper portion and a lower portion, the portions being offset from one another wherein an upper pawl and a lower pawl disposed in the respective portions of the second opening are approximately one-half pitch displaced from one another.

7. The ratchet wrench of claim 1, wherein an upper gear and a lower gear are vertically stacked in the first opening in the head, the teeth on the respective gears being approximately one-half pitch circumferentially out of phase with one another, the teeth on each gear being engaged by the teeth of a respective upper and lower pawl, the teeth on the respective pawls being in phase with one another.

8. The ratchet wrench of claim 1, further comprising a drive tang formed on the at least one gear, the drive tang extending outwardly from the bottom of the head of the wrench.

9. A ratchet wrench having a head, the head having a bottom, a first opening formed in the head, a second opening formed in the head communicating with the first opening, a gear disposed in the first opening, an upper pawl and a lower pawl disposed in a stacked arrangement in the second opening, each pawl having a set of teeth oriented toward and engageable with the gear, the teeth on the upper pawl being displaced from the teeth on the lower pawl, a lever connected to both pawls wherein rotation of the lever moves both pawls between a forward and a reverse position, wherein the teeth on the pawls work conjointly and alternately engage the gear as the gear is ratcheted, thereby producing a reduction in the backswing arc of the ratchet wrench.

10. A ratchet wrench having a head, the head having a bottom, a first opening formed in the head, a second opening formed in the head communicating with the first opening, a gear disposed in the first opening, an upper pawl and a lower pawl disposed in a stacked arrangement in the second opening, each pawl having a set of teeth oriented toward and engageable with the gear, the pawls being asymmetrical, such that the teeth on the upper pawl are displaced from the teeth on the lower pawl, a lever connected to both pawls wherein rotation of the lever moves both pawls between a forward and a reverse position, wherein the teeth on the pawls work conjointly and alternately engage the gear as the gear is ratcheted, thereby producing a reduction in the backswing arc of the ratchet wrench.

11. A ratchet wrench having a head, the head having a bottom, a first opening formed with head, a second opening formed in the head communicating with the first opening, the second opening having an upper portion and a lower portion, the portions being offset from one another, a gear disposed in the first opening, an upper pawl and a lower pawl disposed in a stacked arrangement in the respective portions of the second opening, each pawl having a set of teeth oriented toward and engageable with the gear, a lever connected to both pawls wherein rotation of the lever moves both pawls between a forward and a reverse position, wherein the teeth on the pawls work conjointly and alternately engage the gear as the gear is ratcheted, thereby producing a reduction in the backswing arc of the ratchet wrench.

12. In a ratchet wrench having a pawl means cooperating with a gear means, the improvement wherein either one of the pawl and gear means comprises two elements stacked vertically, mounted for conjoint rotation, said two elements being staggered circumferentially with respect to each other.

13. The improvement of claim 12, wherein the gear means comprises first and second gears having respective teeth staggered circumferentially by one-half pitch.

14. The improvement of claim 12, wherein the gear means comprises a single gear having an upper element and a lower element, teeth being formed on the upper element and the lower element, the respective teeth being staggered circumferentially by one-half pitch.

* * * * *